US011073141B2

(12) United States Patent
Parsons et al.

(10) Patent No.: US 11,073,141 B2
(45) Date of Patent: Jul. 27, 2021

(54) PRESSURE-DRIVEN METERED MIXING DISPENSING PUMPS AND METHODS

(71) Applicant: WHIRLPOOL CORPORATION, Benton Harbor, MI (US)

(72) Inventors: Matthew C. Parsons, Dowagiac, MI (US); Robert J. Pinkowski, Baroda, MI (US); Nicholas E. Righetti, Saint Joseph, MI (US); Ricardo N. Schiesser, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 277 days.

(21) Appl. No.: 16/019,671

(22) Filed: Jun. 27, 2018

(65) Prior Publication Data

US 2018/0306174 A1 Oct. 25, 2018

Related U.S. Application Data

(60) Division of application No. 15/687,797, filed on Aug. 28, 2017, now Pat. No. 10,066,611, which is a (Continued)

(51) Int. Cl.
*F04B 13/02* (2006.01)
*A47L 15/44* (2006.01)
(Continued)

(52) U.S. Cl.
CPC ..... *F04B 13/02* (2013.01); *A47L 15/4418* (2013.01); *F04B 9/107* (2013.01);
(Continued)

(58) Field of Classification Search
CPC .. F04B 9/10; F04B 9/103; F04B 9/107; F04B 9/1076; F04B 13/00; F04B 13/02;
(Continued)

(56) References Cited

U.S. PATENT DOCUMENTS 2,789,510 A 4/1957 Meynig
3,547,560 A * 12/1970 Miller ..... A47L 15/4427 417/375
(Continued)

FOREIGN PATENT DOCUMENTS

DE 2611493 A1 9/1977
EP 1444394 B1 7/2007
(Continued)

OTHER PUBLICATIONS

European Search Report for Corresponding EP15164901.9, dated Nov. 4, 2015.

*Primary Examiner* — Charles G Freay
*Assistant Examiner* — Chirag Jariwala
(74) *Attorney, Agent, or Firm* — McGarry Bair PC

(57) ABSTRACT

A pressure-driven metered treating chemistry dispensing pump for a laundry treating appliance having a housing having first, second and third chambers, with the first and second chambers each in fluid communication with the third chamber; a fluid inlet fluidly coupling a first fluid to the first chamber; an outlet fluidly coupled to the third chamber; a piston disposed in the housing; wherein, when the piston moves in a first direction in response to the first fluid entering the first chamber via the fluid inlet, the second chamber decreases in volume thereby ejecting at least some of the second fluid from the second chamber into the third chamber, and when the piston moves in a second direction, different from the first direction, the first chamber decreases in volume thereby ejecting at least some of the first fluid from the first chamber into the third chamber to mix the at least some of the first fluid and the at least some of the second fluid to form a mixture in the third chamber, which can be emitted through the outlet.

19 Claims, 7 Drawing Sheets

Related U.S. Application Data continuation of application No. 14/302,529, filed on Jun. 12, 2014, now Pat. No. 9,790,935.

(51) Int. Cl.

| | |
|---|---|
| ***F04B 53/10*** | (2006.01) |
| ***F04B 19/22*** | (2006.01) |
| ***F04B 9/107*** | (2006.01) |
| ***F04B 53/12*** | (2006.01) |
| ***F04B 53/14*** | (2006.01) |

(52) U.S. Cl.

CPC ..... *F04B 9/1076* (2013.01); *F04B 19/22* (2013.01); *F04B 53/10* (2013.01); *F04B 53/12* (2013.01); *F04B 53/123* (2013.01); *F04B 53/14* (2013.01)

(58) Field of Classification Search

CPC ..... F04B 19/20; F04B 19/22; F04B 53/10; F04B 53/1037; F04B 53/1047; F04B 53/1057; F04B 53/12; F04B 53/123; F04B 53/14; F04B 7/0208; F04B 7/0216; F04B 7/0225; F04B 7/06; F04B 7/04; F04F 1/00; F04F 1/18; F04F 1/20; F04F 5/463; A47L 15/4418

USPC ..... 417/315, 484, 509, 569–571, 559, 560, 417/377, 378, 551, 555.1; 137/99; 222/129.2, 129.3, 133

See application file for complete search history.

(56) References Cited

U.S. PATENT DOCUMENTS

| | | | | |
|---|---|---|---|---|
| 4,076,465 | A | 2/1978 | Pauliukonis | |
| 4,141,467 | A | 2/1979 | Augustijn et al. | |
| 4,349,130 | A * | 9/1982 | Bair | G01F 13/00 222/129.2 |
| 4,424,829 | A * | 1/1984 | Millington | B62D 5/062 137/574 |
| 4,967,936 | A | 11/1990 | Bingler | |
| 6,712,242 | B2 | 3/2004 | Friedman | |
| 8,196,441 | B2 | 6/2012 | Hendrickson et al. | |
| 8,388,695 | B2 | 3/2013 | Hendrickson et al. | |
| 8,397,328 | B2 | 3/2013 | Hendrickson et al. | |
| 8,397,544 | B2 | 3/2013 | Hendrickson | |
| 8,438,881 | B2 | 5/2013 | Ihne et al. | |
| 8,813,526 | B2 | 8/2014 | Doyle et al. | |
| 8,851,335 | B2 | 10/2014 | Ciavarella et al. | |
| 2010/0000264 | A1 | 1/2010 | Luckman et al. | |
| 2010/0000581 | A1 | 1/2010 | Doyle et al. | |
| 2012/0266389 | A1 | 10/2012 | Ihne et al. | |
| 2015/0090616 | A1 | 4/2015 | Sasaki et al. | |

FOREIGN PATENT DOCUMENTS

| | | | | |
|---|---|---|---|---|
| EP | 2070462 | A1 * | 6/2009 | D06F 39/022 |
| EP | 2070462 | A1 | 6/2009 | |
| EP | 2441373 | B1 | 12/2013 | |
| GB | 2037880 | A | 7/1980 | |

* cited by examiner

PRESSURE-DRIVEN METERED MIXING DISPENSING PUMPS AND METHODS

CROSS-REFERENCE TO RELATED APPLICATION(S)

This application is a divisional application of U.S. patent application Ser. No. 15/687,797, filed Aug. 28, 2017, now U.S. Pat. No. 10,066,611, issued Sep. 4, 2018, which is a continuation of U.S. patent application Ser. No. 14/302,529, filed Jun. 12, 2014, now U.S. Pat. No. 9,790,935, issued Oct. 17, 2017, both of which are incorporated herein by reference in their entirety.

FIELD OF THE DISCLOSURE

This disclosure relates generally to dispensing pumps, and, more particularly, to pressure-driven metered mixing dispensing pumps and methods.

BACKGROUND

Some traditional appliances, such as a clothes washer, a clothes dryer, a clothes refresher, a non-aqueous clothes system, a dishwasher, etc. have dispensers for dispensing treating chemistry into a chamber in which items are placed for treatment. Other appliances, such as a refrigerator, a home carbonation device, a soda fountain machine, etc. may also have dispensers for dispensing other liquids such as a flavoring, etc.

SUMMARY

In one aspect, a pressure-driven metered mixing dispensing pump, including a housing, a piston disposed in the housing at least partially defining first, second and third chambers, the first and second chambers in fluid communication with the third chamber, and a flow control device selectively controllable to direct substantially all of first fluid in the first chamber into the third chamber to be mixed in the third chamber with second fluid from the second chamber, and direct substantially none of the first fluid into the third chamber.

In another aspect, a pressure-driven metered mixing dispensing pump, including a first chamber, a second chamber, a third chamber in fluid communication with the first and second chambers, and a fluid outlet in fluid communication with the third chamber, wherein selectively supplying a first fluid into the first chamber causes at least a portion of the first fluid and at least a portion of second fluid supplied into the second chamber to be mixed in the third chamber and dispensed through the fluid outlet.

In another aspect, a pressure-driven metered dispensing pump, including first, second and third chambers, and a member to eject a first fluid from the second chamber into the third chamber responsive to second fluid entering the first chamber, wherein at least some of the second fluid is ejected from the first chamber into the third chamber responsive to a movement of the member.

In yet another aspect, a dispensing system including a water system having an inlet and an outlet, the inlet of the water system connected to a pressurized water source, a liquid container to provide a dispensing liquid, a water pressure management system that manages pressure of the water at the outlet of the water system, and a pumping system including a housing, a water inlet fluidically connecting the water system to the pumping system, a dispensing inlet fluidically connecting the liquid container to the pumping system, and a pumping mechanism, wherein the pumping mechanism is driven from a first position in a dispensing step due to increasing the water pressure at the water inlet of the pumping system, and is biased to return to the first position due to decreasing the water pressure at the water inlet, wherein the dispensing system provides for mixing of the water and the dispensing liquid.

In yet another aspect, a water driven dispensing pump including a storage region fillable with a dispensing fluid, a water line inlet including a pressure gate, a piston, wherein the piston is biased toward a first position, and a dispensing outlet, wherein the pressure gate allows for water pressure from the water line inlet to be applied against the piston to move it from the first position to a second position, and wherein the movement of the piston between the first and second positions aids in: moving the dispensing fluid from the storage region to the dispensing outlet, and moving the water from the water inlet to the dispensing outlet.

DETAILED DESCRIPTION

Traditional dispensing pumps for appliances use electrically driven pumps that may be cost prohibitive and/or may require sophisticated pump drive control. Example pressure-driven metered mixing dispensing pumps disclosed herein are enhanced positive displacement pumps driven by water pressure. The disclosed pumps are capable of dispensing accurate amounts of, for example, liquid treating chemistry mixed with water at selectively different and/or variable concentrations. Because these benefits are achieved via water valve control and eliminate the need for an electric metering pump substantial cost savings can be achieved using the disclosed example pumps. Further, because mixing and/or dilution can occur within the disclosed pumps eliminating imprecise and/or costly external mixing and/or dilution. Moreover, because the example pumps disclosed herein use negative pressure to draw treating chemistry into the pumps, there is more flexibility in locating a reservoir containing the treating chemistry within an appliance. Many conventional dispensers rely on gravity to move treating chemistry, and thus reservoirs must be located up high in the appliance.

Figure 1:
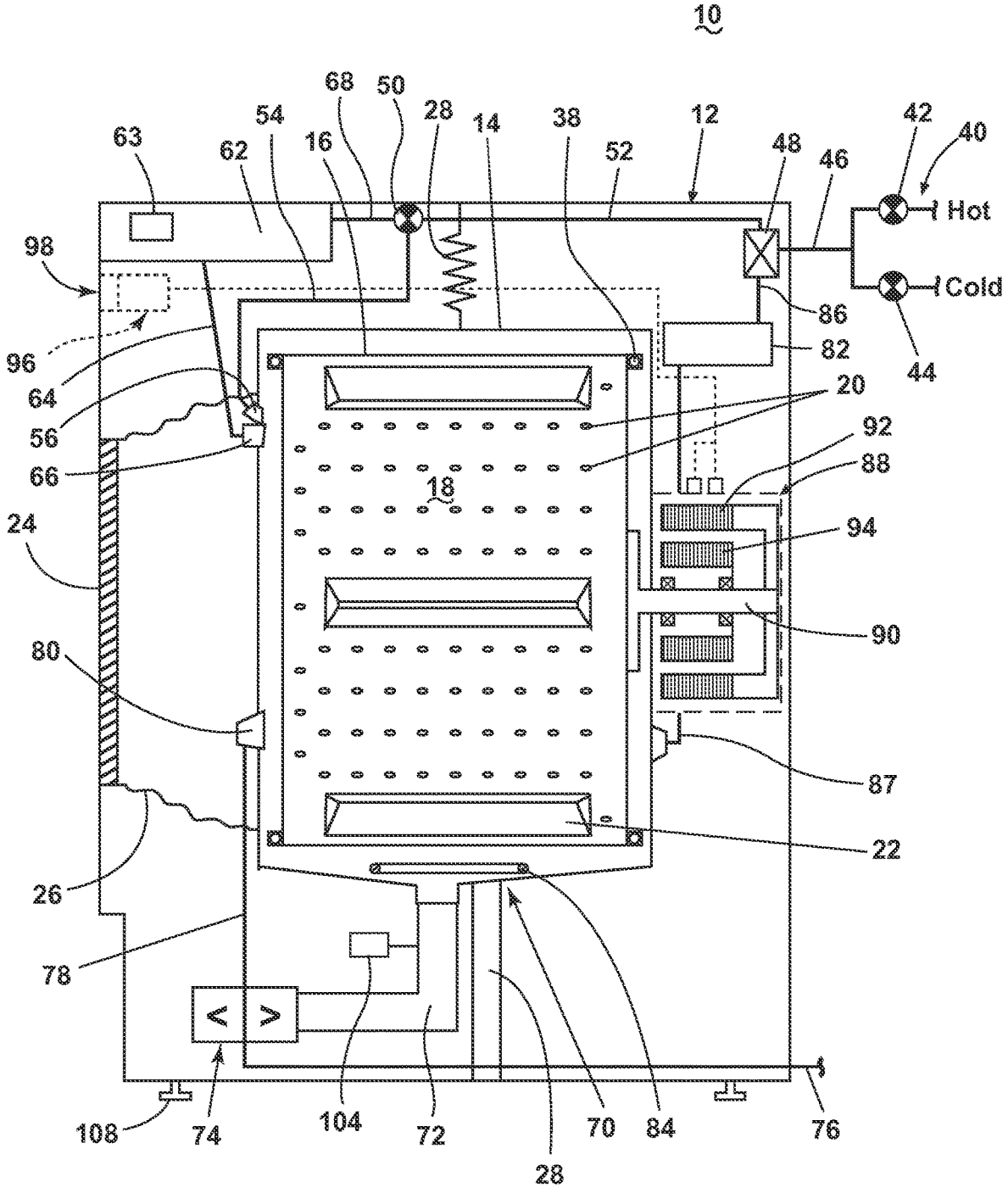
FIG. 1 is a schematic view of an example appliance in the form of a laundry treating appliance having a pressure-driven metered mixing dispensing pump constructed in accordance with the teachings of this disclosure.

FIG. 1 is a schematic view of an example laundry treating appliance. The laundry treating appliance may be any appliance that performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. Moreover, while the examples disclosed herein are described with reference to laundry appliances, it should be understood that the example pressure-driven metered dispensing pumps disclosed herein may be a part of and/or be used in association with any number and/or type(s) of other appliances and/or devices such as, but not limited to, a dishwasher, a refrigerator, a soda fountain machine, a home carbonation drink machine, etc. Further still, while the examples disclosed herein are described with reference to the metering of treating chemistry and the mixing of treating chemistry with water, it should be recognized that the disclosed pumps may be used to meter and/or mix other types of fluids such as, but not limited to, liquids, gels, etc.

The laundry treating appliance of FIG. 1 is illustrated as a horizontal-axis washing machine 10, which may include a structural support system comprising a cabinet 12 that defines a housing within which a laundry holding system resides. The cabinet 12 may be a housing having a chassis and/or a frame defining an interior that encloses components typically found in a conventional washing machine, such as motors, pumps, fluid lines, controls, sensors, transducers, and the like.

The laundry holding system comprises a tub 14 supported within the cabinet 12 by a suitable suspension system and a drum 16 provided within the tub 14, the drum 16 defining at least a portion of a laundry treating chamber 18. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of this disclosure for the laundry holding system to comprise only a tub with the tub defining the laundry treating chamber.

The laundry holding system may further include a door 24 that may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may also include at least one ball balancing ring 38 containing a balancing material moveable within the ball balancing ring 38 to counterbalance an imbalance that may be caused by laundry in the treating chamber 18 during rotation of the drum 16. The balancing material may be in the form of metal balls, fluid or a combination thereof. For example, the ball balancing ring 38 may comprises a plurality of metal balls suspended in a substantially viscous fluid. The ball balancing ring 38 may extend circumferentially around a periphery of the drum 16 and may be located at any desired location along an axis of rotation of the drum 16. When multiple ball balancing rings 38 are present, they may be equally spaced along the axis of rotation of the drum 16.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48, which may direct the flow of liquid to a supply conduit 52. The second diverter mechanism 50 on the supply conduit 52 may direct the flow of liquid to a tub outlet conduit 54, which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62, which may be a single use dispenser, a bulk dispenser or a combination of a single and bulk dispenser. Non-limiting examples of suitable dispensers are disclosed in U.S. Pat. No. 8,196,441 to Hendrickson et al., filed Jul. 1, 2008, entitled "Household Cleaning Appliance with a Dispensing System Operable Between a Single Use Dispensing System and a Bulk Dispensing System," U.S. Pat. No. 8,388,695 to Hendrickson et al., filed Jul. 1, 2008, entitled "Apparatus and Method for Controlling Laundering Cycle by Sensing Wash Aid Concentration," U.S. Pat. No. 8,397,328 to Hendrickson et al., filed Jul. 1, 2008, entitled "Apparatus and Method for Controlling Concentration of Wash Aid in Wash Liquid," U.S. Pub. No. 2010/0000581 to Doyle et al., filed Jul. 1, 2008, now U.S. Pat. No. 8,813,526, issued Aug. 26, 2014, entitled "Water Flow Paths in a Household Cleaning Appliance with Single Use and Bulk Dispensing," U.S. Pub. No. 2010/0000264 to Luckman et al., filed Jul. 1, 2008, entitled "Method for Converting a Household Cleaning Appliance with a Non-Bulk Dispensing System to a Household Cleaning Appliance with a Bulk Dispensing System," U.S. Pat. No. 8,397,544 to Hendrickson, filed Jun. 23, 2009, entitled "Household Cleaning Appliance with a Single Water Flow Path for Both Non-Bulk and Bulk Dispensing," and U.S. Pat. No. 8,438,881, filed Apr. 25, 2011, entitled "Method and Apparatus for Dispensing Treating Chemistry in a Laundry Treating Appliance," which are herein incorporated by reference in full.

Regardless of the type of dispenser used, the dispenser 62 may be configured to dispense a treating chemistry directly to the tub 14 or mixed with water from the liquid supply system through a dispensing outlet conduit 64. To meter treating chemistry, and/or to mix a metered dose of treating chemistry with water, the example dispenser 62 includes a pressure-driven metered mixing dispensing pump 63 constructed in accordance with the teachings of this disclosure. As described in detail below the example pressure-driven metered mixing dispensing pump 63 of FIG. 1 meters an amount of treating chemistry and mixes the treating chemistry with water in response to the selective supplying of water to the pump 63 by selectively controlling a water valve (e.g., water valve 335 of FIG. 3). The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, surfactants, color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system that may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88, which may be directly coupled with the drum 16 through a drive shaft 90 to rotate the drum 14 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotate the drum 16 at various speeds in either rotational direction.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to this disclosure. It is contemplated that the controller is a microprocessor-based controller that implements control software and sends/receives one or more electrical signals to/from each of the various working components to affect the control software. As an example, proportional control (P), proportional integral control (PI), and proportional derivative control (PD), or a combination thereof, a proportional integral derivative control (PID control), may be used to control the various components.

Figure 2:
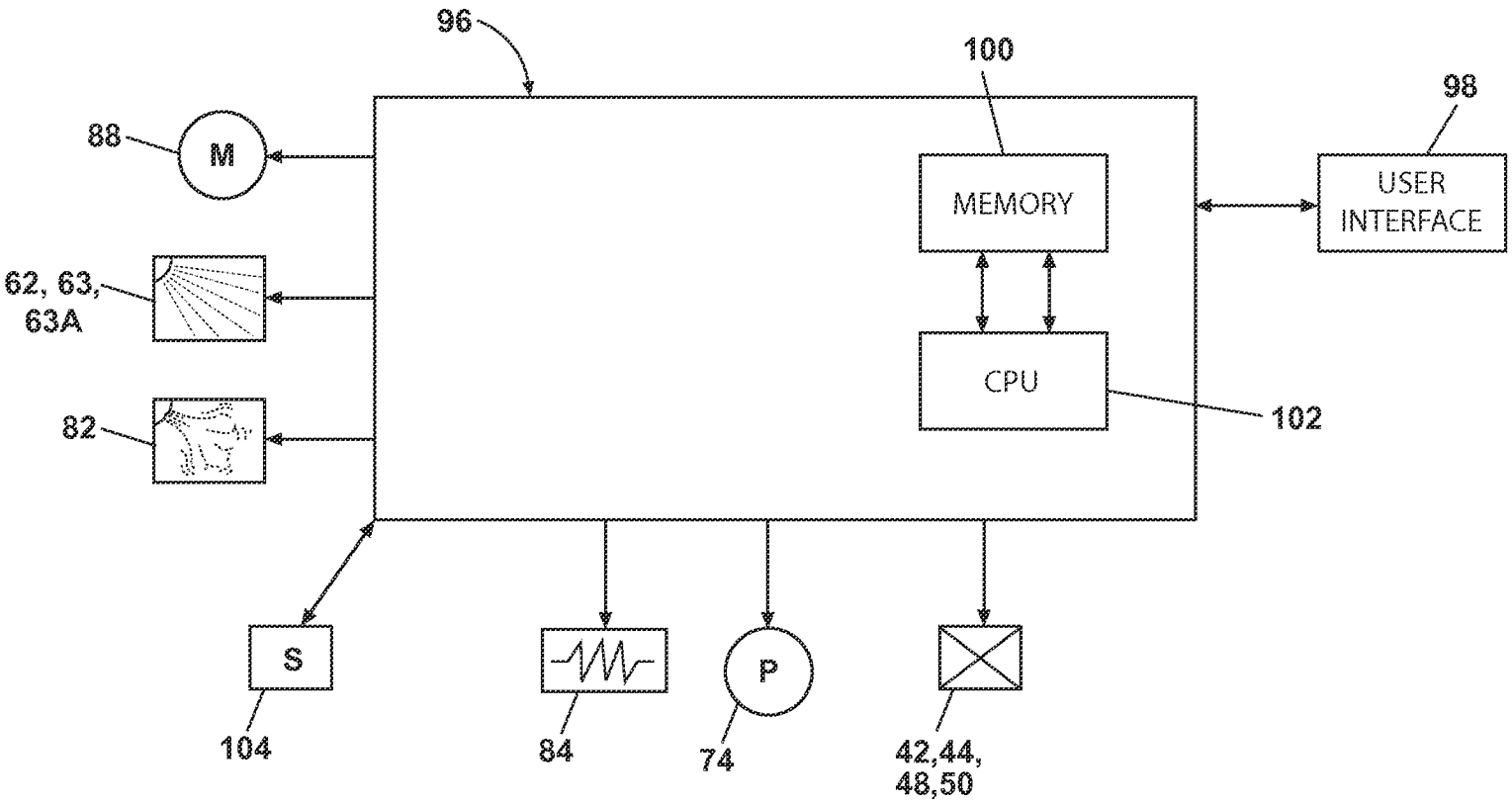
FIG. 2 is a schematic of an example control system for the laundry treating appliance of FIG. 1.

As illustrated in FIG. 2, the controller 96 may be provided with a memory 100 and a central processing unit (CPU) 102. The memory 100 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. For example, the memory 100 may be used to store a plurality of drum acceleration ramp profiles for respective ones of a plurality of ball balancing ring fluid viscosities. The database or table may also be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the pressure-driven metered mixing dispensing pump 63, a water valve 63A associated with the pressure-driven metered mixing dispensing pump 63, the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor, a load position sensor, a ball balancing ring ball position sensor, a motor temperature sensor, and a motor torque sensor, which may be used to determine a variety of system and laundry characteristics, such as ball balancing ring 38 temperature, ball balancing ring ball position(s), load position and/or laundry load inertia or mass.

The washing machine 10 may have one or more pairs of feet 108 extending from the cabinet 12 and supporting the cabinet 12 on the floor.

Figure 3:
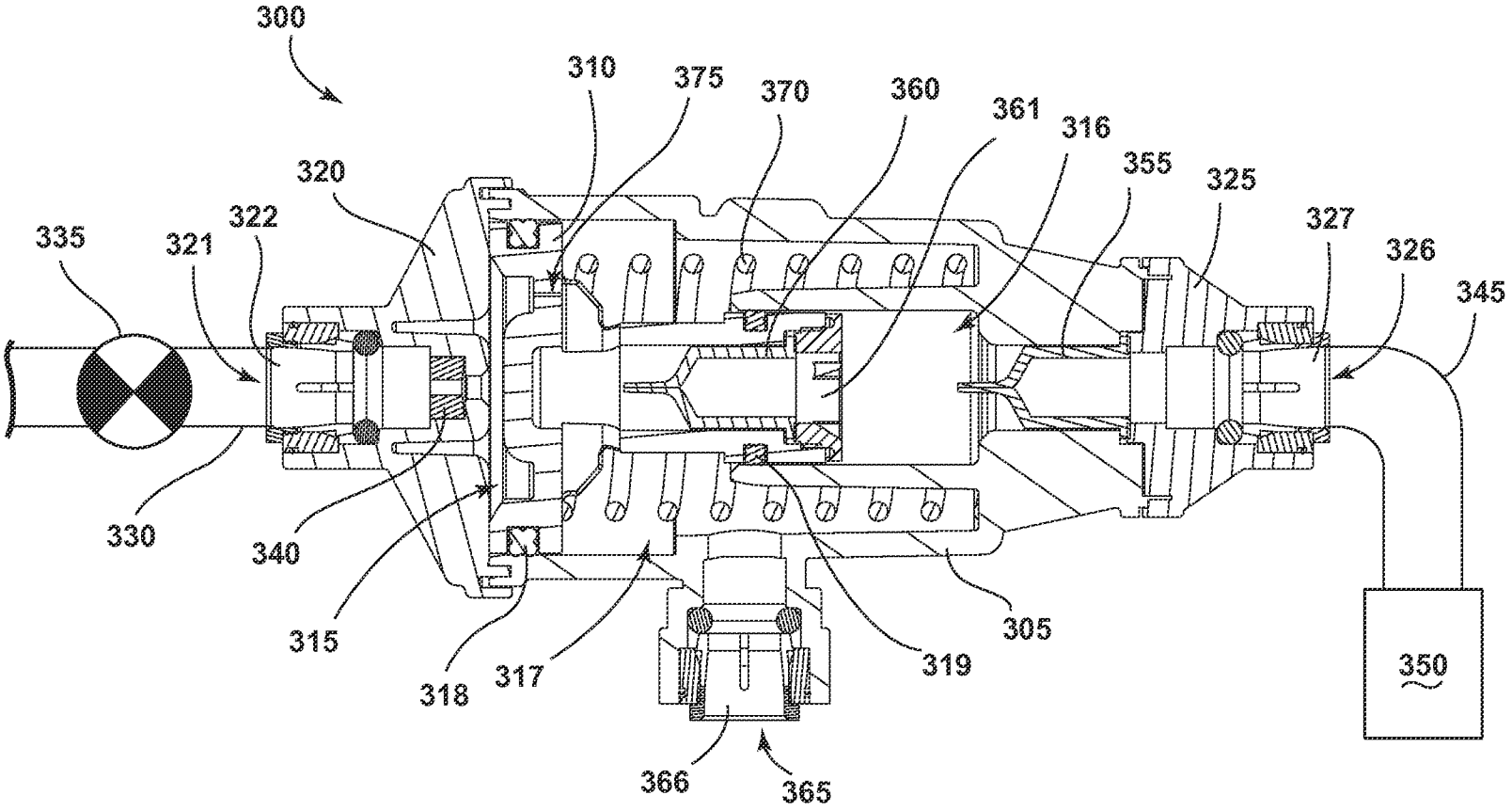
FIG. 3 is a cross-sectional view of an example manner of implementing the pressure-driven metered mixing dispensing pump of FIG. 1.
Figure 4:
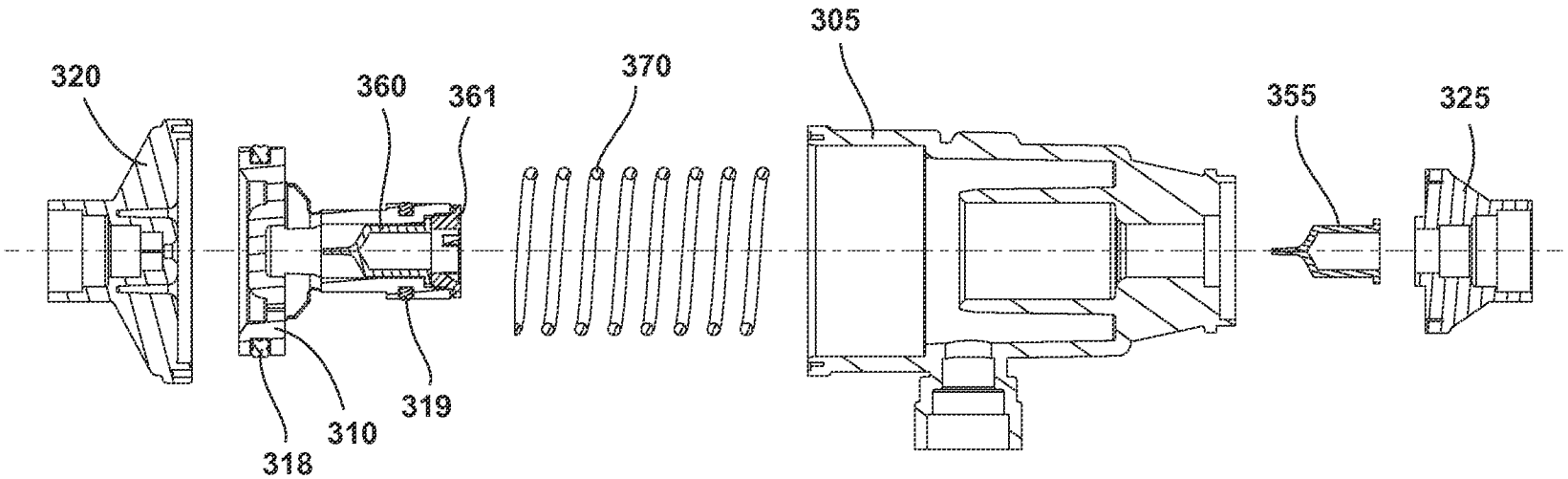
FIG. 4 is an exploded cross-sectional view of the pressure-driven metered mixing dispensing pump of FIG. 3.

FIG. 3 is a cross-sectional side view of an example pressure-driven metered mixing dispensing pump 300 that may be used to implement the example dispensing pump 63 of FIG. 1. FIG. 4 is an exploded cross-sectional view of the example pump 300 of FIG. 3. As shown and as described in detail below, the example pump 300 of FIGS. 3 and 4 is an enhanced positive displacement pump that allows two fluids to be mixed within the pump 300. FIGS. 5-8 illustrate example operations of the example pump 300 of FIGS. 3 and 4.

As used herein, terms such as left, right, top, bottom, end, etc. are with reference to the orientation of the pump 300 shown in FIGS. 3 and 4. If the pump 300 is considered with respect to another orientation, it should be understood that such terms need to be correspondingly modified.

Figure 5:
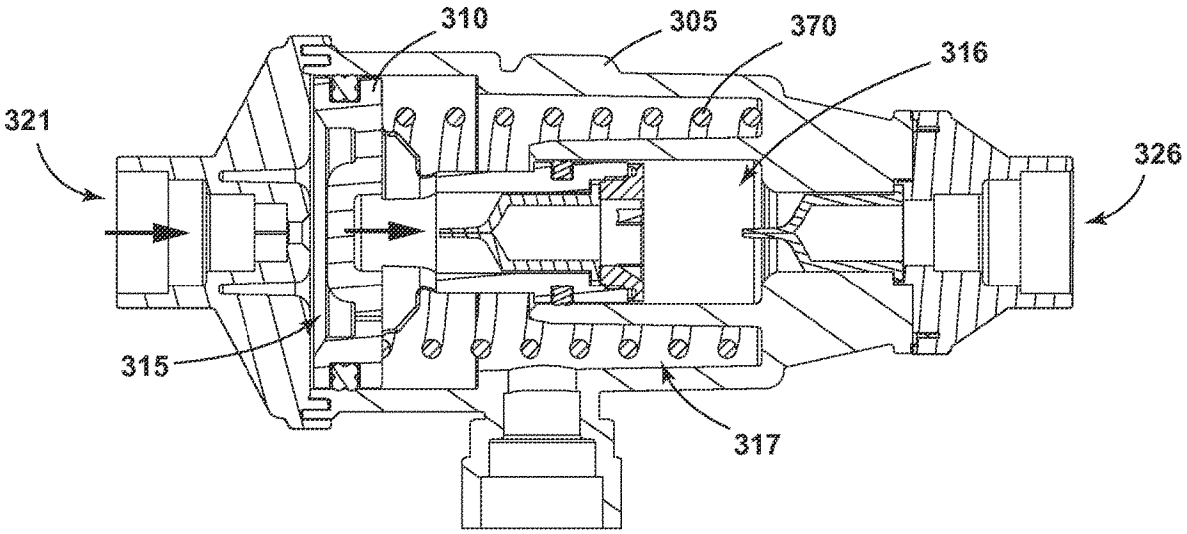
FIGS. 5-7 are cross-sectional views showing example operations of the pressure-driven metered mixing dispensing pump of FIG. 3.
Figure 6:
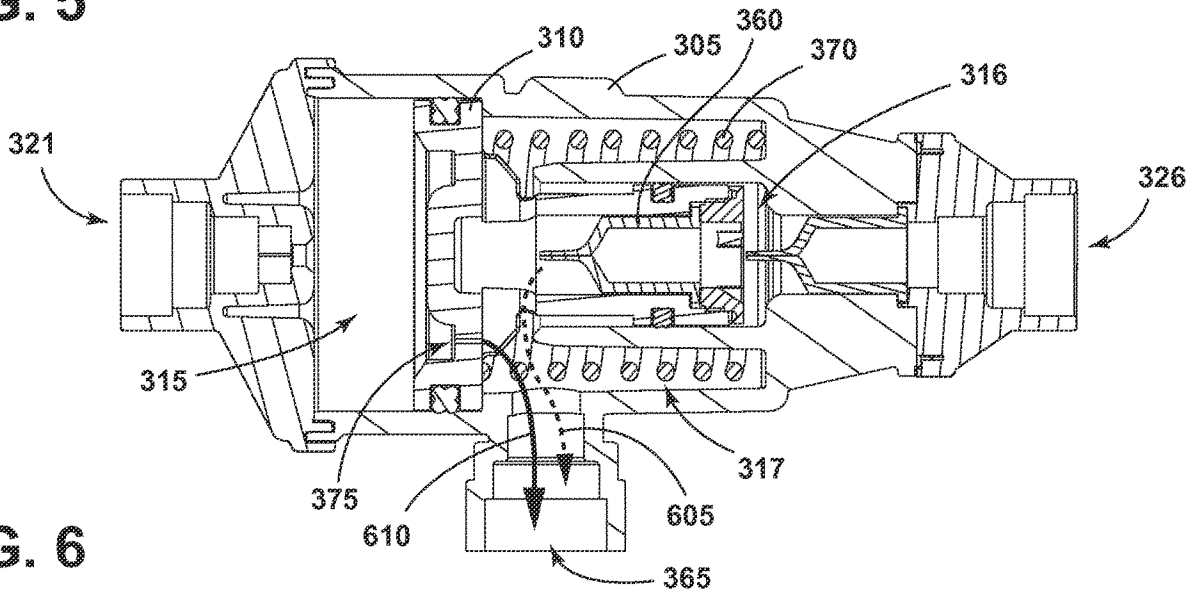
Figure 7:
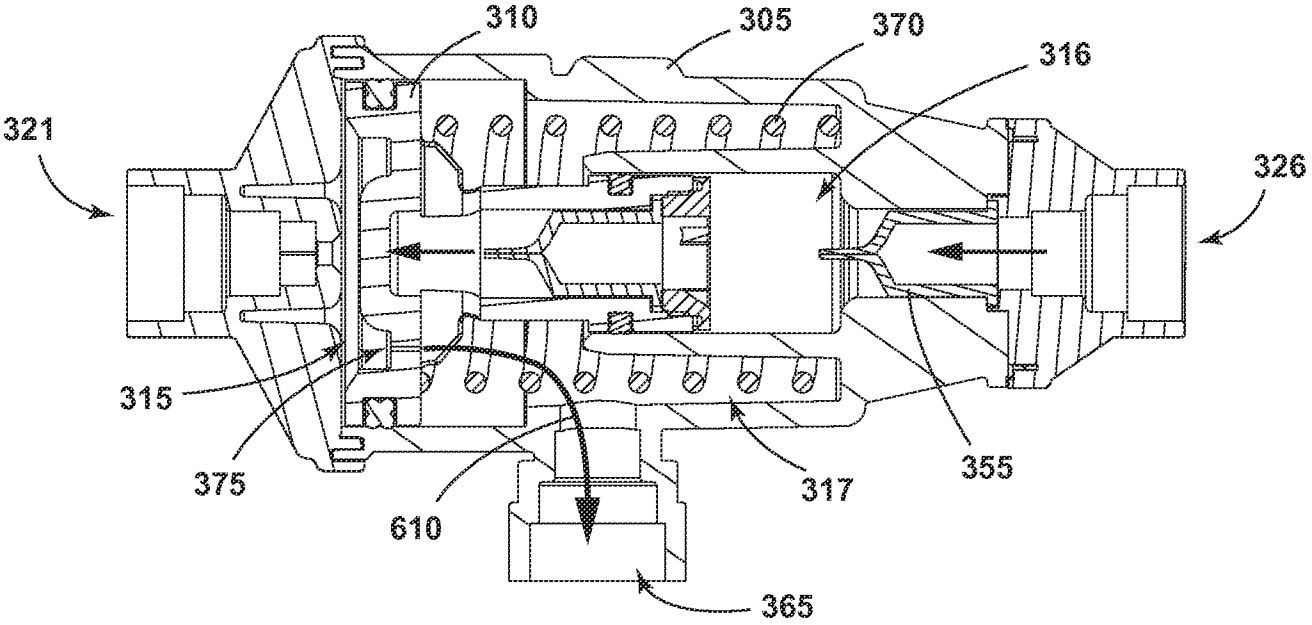

The example pump 300 of FIG. 3 includes a housing 305 in which a piston 310 is disposed. The piston 310 moves left and right within the housing 305, as shown in FIGS. 5-7. The piston 310 and the housing 305 at least partially define first, second and third chambers 315, 316 and 317. In the example of FIGS. 3 and 4, seals 318 and 319 between the housing 305 and the piston 310 at least partially fluidly isolate the chambers 315-317 from each other. In some examples, the seals 318, 319 are designed and/or selected to leak respective fluids around the piston 310 under temporary high line pressure conditions.

On the left end of the housing 305, the pump 300 includes a cap 320 that may, for example, be friction welded to the housing 305. On the right end of the housing 305, the pump 300 includes another cap 325 that may also be friction welded to the housing 305. Additionally and/or alternatively, either or both of the caps 320, 325 may be attached or affixed to the housing 305 via other means such as, for example, seals, clips, screws, adhesive, etc., and/or may be integral parts of the housing 305.

In the example of FIG. 3, a water inlet 321 is defined in the left cap 320 into which a push-to-connect tube fitting 322 is positioned. The fitting 322 is configured to enable a plastic tube 330 to connect the pump 300 to a water supply valve 335. As described below in more detail, the controller 96 of FIGS. 1 and 2, and/or any other controller, can operate the example pump 300 by controlling the water valve 335 to selectively supply water to the pump 300.

To allow the example pump 300 to work under different water pressures, the example water inlet 321 includes a flow control device 340 such as a flow control washer. The flow control device 340 protects the pump 300 from high water pressure conditions. In some examples, the water inlet 321 may further include a one-way valve 805 (see FIG. 8) that provides resistance to negative water line pressures.

In the example of FIG. 3, a treating chemistry inlet 326 is defined in the right cap 325 into which a push-to-connect tube fitting 327 is positioned. The fitting 327 is configured to enable a plastic tube 345 to connect the pump 300 to a treating chemistry reservoir, container, pod, cartridge, or supply 350.

To control the flow of treating chemistry from the reservoir 350 into the second chamber 316, the pump 300 includes a one-way valve 355. In the example of FIG. 3, the one-way valve 355 is a duck-bill valve. However, any other type of one-way valve may be used instead. For example, as shown in the alternative manner of implementing the pump 63 of FIG. 1 shown in FIG. 9, the one-way valve 355 may be an umbrella check valve 905.

To control the flow of treating chemistry from the second chamber 316 into the third chamber 317, the pump 300 includes another one-way valve 360. In the illustrated example, the one-way valve 360 is held in place by a retainer 361. In the example of FIG. 3, the one-way valve 360 is a duck-bill valve. However, any other type of one-way valve may be used instead. Moreover, other means of retaining the one-way valve 360 in the piston 310 may be used. In the illustrated example, the outlet of the one-way valve 360 is located within the piston 310, and a portion of the interior of the piston 310 is in fluid communication with the chamber 317. In other words, a portion of the third chamber 317 is disposed within the piston 310. Compared to conventional positive displacement pumps, the placement of the one-way valve 360 within the piston 310 simplifies the flow of the treating chemistry, thereby reducing pressure losses due to viscosity and/or allowing higher viscosity treating chemistry to be metered.

In some examples, the one-way valve 360 is modified and/or used together with a modified retainer 361 having one or more orifices or small passages defined therethrough to provide a momentary or temporary higher pressure or shear force being applied to treating chemistry within the second chamber 316 to, for example, disintegrate the membrane enclosing vesicles of the treating chemistry.

To allow fluid to escape the third chamber 317, the example pump 300 of FIG. 3 includes a fluid outlet 365 defined in the housing 305 into which a push-to-connect tube fitting 366 is positioned. The fitting 366 is configured to enable a plastic tube (not shown) to directly or indirectly carry water, treating chemistry and/or a mixture of treating chemistry and water from the pump 300 to, among other possible places, the dispensing nozzle 66 and the tub 14 (FIG. 1).

While push-to-connect tube fittings 322, 327, 366 and plastic tubing 330, 340 are shown in FIG. 3, it should be understood that other types of connectors (e.g., compression fittings, etc.) and/or types of fluid lines may be used.

To apply a leftward force to the piston 310, the pump 300 includes a spring 370. As the piston 310 moves rightward in response to water of sufficient pressure (e.g., 20 to 120 pounds per square inch (PSI)) entering the first chamber 315 via the inlet 321, the spring 370 compresses and becomes loaded (see FIGS. 5 and 6). When the water valve 335 is closed and water exits from the first chamber 315, the spring 370 exerts a leftward force that returns the piston 310 to its leftward position.

In the illustrated example, the first chamber 315 has a larger diameter than the second chamber 316 by a ratio of approximately 2:1. With such a ratio, the thrust force caused by water pressure on the piston 310 under expected water pressures (e.g., 20 to 120 PSI) is sufficient to overcome the leftward force exerted by the spring 370 when fully loaded, piston friction forces, and the leftward force exerted on the piston 310 by treating chemistry in the second chamber 316. Of course, other ratios may be selected for other operating conditions and/or applications.

To allow water to escape the first chamber 315 as the piston 310 is pushed leftward by the spring 370, the example piston 310 of FIG. 3 includes one or more orifices, one of which is designated at reference numeral 375. Water passing through the orifice 375 into the third chamber 317 mixes with treating chemistry entering the third chamber 317 via the one-way valve 360 and the mixture is discharged from the third chamber 317 through the outlet 365, and/or the entering water washes and/or rinses treating chemistry remaining in or on the walls of the third chamber 317 out through the outlet 365. The example orifice 375 has a position, a shape and/or dimension(s) that bleeds water at a predetermined rate selected based on force(s) expected to be exerted on the piston 310, expected and/or anticipated concentration(s) of treating chemistry, a desired amount of mixing of the treating chemistry and water, etc. In some example, the orifice 375 is shaped to act as a spray nozzle to improve mixing and/or removal of the treating chemistry from the third chamber 317. In some examples, the orifice 375 has a diameter of 1.5 millimeters (mm), and the pump 300 discharges a mixture of 4 milliliters (mL) of treating chemistry and 100 mL of water per cycle of the pump 300.

Use of the orifice 375 provides numerous advantages that aren't possible with a conventional positive displacement pump. For example, precise mixing occurs within the third chamber 317 of the example pump 300 (conventional positive displacement pumps can only discharge concentrated treating chemistry and rely on sometimes imprecise and/or costly external mixing and/or dilution), there is no need to bleed off water from the first chamber 315 via another valve, a separate external line or other means, the water bled into the first chamber 315 reduces treating chemistry buildup within the third chamber 317, etc.

It should be understood that there may be more than one orifice, and that the orifices need not have the same relative position, shape and/or dimension(s). In some examples, the seal 318 is configured to provide a desired bleeding flow rate similar to the orifice 375, and the orifice 375 is omitted. In such examples, the seal 318 could alternatively be a diaphragm-type of seal having the desired bleeding flow rate. In still other examples, the orifice 375 is replaced by an orifice, an internal flow line, and/or an external flow line that bypasses the piston 310. In yet more examples, the orifice 375 is replaced by any other means to bleed water such as, but not limited to, a needle valve.

It is also contemplated that in other examples that all or some of the water in the first chamber 315 is not bled into the third chamber 317. For example, all of the water could be bled externally from the first chamber 315 into the tub 14 (i.e., into the treating chamber of the laundry appliance 10) where, for example, it is used as part of a treating cycle of operation. In such an example, the pump 300 discharges concentrated treating chemistry. After use in the treating cycle of operation, the bled water would be discharged from the tub 14 via the pump 74. In other examples, a water flow device (e.g., a three-way valve) is selectively controlled to (a) bleed water from the first chamber 315 into the third chamber 317 so the pump 300 discharges mixed or diluted treating chemistry, or (b) bleed water from the first chamber 315 into the tub 14 so the pump 300 discharges concentrated treating chemistry. In such examples, the water flow device could be controlled so that a portion of the water in the first chamber 315 is bled into the tub 14, and the remainder is bled into the third chamber 317. Via any combination of these examples, variable dilution of treating chemistry can be selectively obtained using the disclosed example pump 300.

Turning to FIGS. 5-7, example cycle of operation of the example pump 300 of FIGS. 3 and 4 are shown. As shown in FIG. 5, as a first fluid (e.g., water) of sufficient pressure enters first chamber 315 via the inlet 321, the piston 310 begins to move rightward.

As shown in FIG. 6, as the first fluid continues to enter the chamber 315, the piston 310 continues moving rightward, the volume of the first chamber 315 increases, and the volume of the second chamber 316 decreases. As the volume of the second chamber 316 decreases the pressure of second fluid 605 (e.g., a treating chemistry) present in the second chamber 316 increases and, thus, passes, flows and/or is ejected through the one-way valve 360 into the third chamber 317. As the second fluid 605 is being ejected into the third chamber 317, first fluid 610 passes through the orifice 375 into the third chamber 317 and mixes with the second fluid 605. The mixture of the first and second fluids 605, 610 is discharged through the outlet 365.

As shown in FIG. 7, when the flow of first fluid into the first chamber 315 is stopped or discontinued, the spring 370 moves the piston 310 leftward thereby decreasing the volume of the first chamber 315, and increasing the volume of the second chamber 316. As the volume of the first chamber 315 decreases the first fluid 610 continues to pass through the orifice 375 into the third chamber 317. As the first fluid 610 continues to pass into the third chamber 317 any second fluid 605 in the third chamber 317 is diluted, rinsed and/or washed out of the pump 300 through the outlet 365. As the volume of the second chamber 316 increases, a negative pressure is created inside the second chamber 316 thereby drawing second fluid into the second chamber 316 via the one-way valve 355.

It should be understood that the amount of the second fluid that is discharged, the amount of the first fluid mixed with the second fluid, and/or the amount of the first fluid used to remove remaining second fluid from the third chamber 317 during each cycle of operation of the pump 300 can be selectively, adaptively and/or dynamically controlled. For example, a larger amount of the first fluid can be used to remove second fluid from the third chamber 317 by holding the position shown in FIG. 6 for a longer period time. Because the full volume of the second chamber 316 is known, precise amounts of the second fluid can be dispensed. An example second chamber 316 is capable of holding 4 mL of second fluid and, thus, a full stroke of the pump 300 would dispense precisely 4 mL. However, different amounts of the second fluid can be dispensed using a sensor to sense the position of the piston 310 and/or by shortening the amount of time that the first fluid is allowed to enter the first chamber 315. Moreover, additional amounts of the second fluid can be discharged by cycling the pump 300 multiple times. Further still, the water line pressure applied to the pump 300 may be selectively and/or dynamically manipulated to maintain the position of the piston 310 such that the chamber 317 is as large as desired and/or reasonably feasible, thereby allowing the chamber 317 to the rinsed for an extended period of time. Thus, it will be understood that the example pumps disclosed herein can be adaptively, selectively, and dynamically controlled to dispense any amount of the second fluid mixed with any amount of the first fluid.

Figure 8:
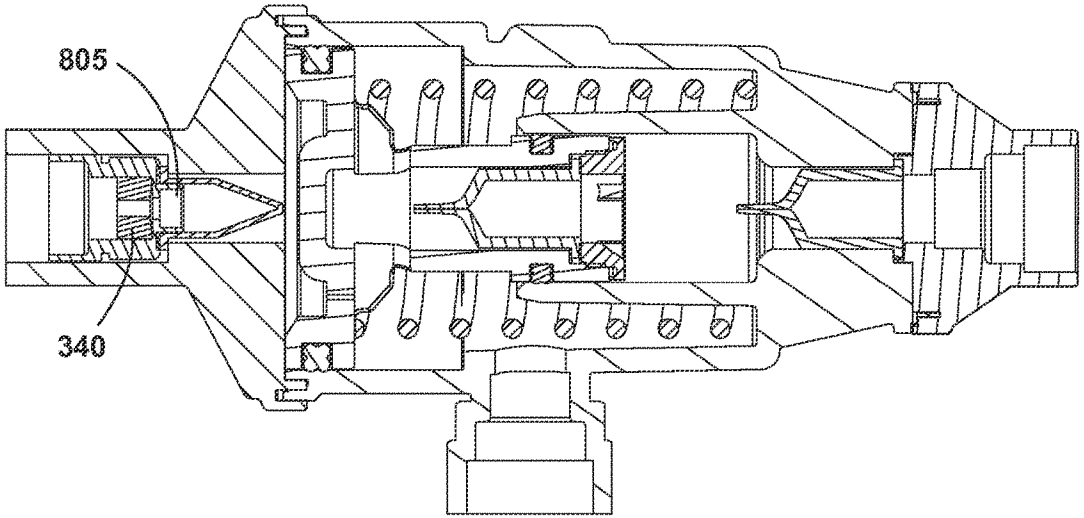
FIGS. 8 and 9 are cross-sectional views of alternative example manners of implementing the pressure-driven metered mixing dispensing pump of FIG. 1.
Figure 9:
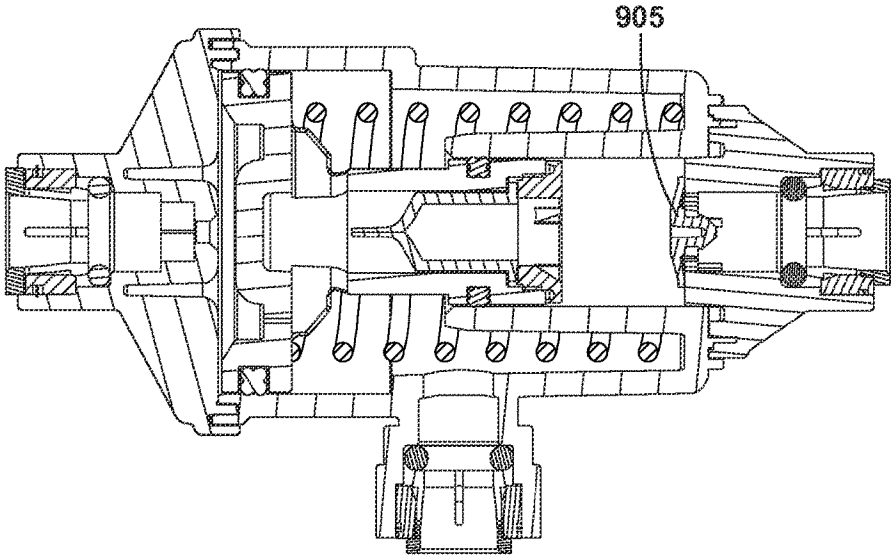

FIGS. 8 and 9 illustrate alternative manners of implementing the example pump 63 of FIG. 1. For clarity, only those reference numerals needed to illustrate differences from FIGS. 3 and 4 will be shown in FIGS. 8 and 9. In the illustrated example of FIG. 8, the inlet 321 includes the flow control device 340 and the one-way valve 805. In the illustrated example of FIG. 9, the duck-bill valve 355 of FIG. 3 is replaced with an umbrella check valve 905. Of course others of the one-way valves 360, 805 may be replaced with the same and/or different type(s) of one-way valves.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A pressure-driven metered mixing dispensing pump, comprising:

a housing;

a piston disposed in the housing at least partially defining first, second and third chambers within the housing;

the first and second chambers in fluid communication with the third chamber;

wherein the piston is selectively controllable to move between a first position and a second position:

wherein in the first position, substantially none of a first fluid in the first chamber is directed into the third chamber;

wherein in the second position, a volume of the first chamber is expanded and substantially all of the first fluid in the first chamber is directed into the third chamber and a volume of the second chamber is contracted causing a second fluid from the second chamber to enter the third chamber and be mixed in the third chamber with the first fluid from the first chamber; and wherein the piston has at least one orifice defined therethrough to spray at least some of the first fluid from the first chamber into the third chamber.

2. The pressure-driven metered mixing dispensing pump as defined in claim 1, wherein movement between the first position and the second position directs a portion of the first fluid into the third chamber to be mixed with the second fluid.

3. The pressure-driven metered mixing dispensing pump as defined in claim 1, further comprising a drain line to discharge a portion of the first fluid not directed into the third chamber into a treating chamber of an appliance.

4. The pressure-driven metered mixing dispensing pump as defined in claim 1, further comprising at least one of an internal flow line, an external flow line, a piston seal and/or a diaphragm-type seal configured to have a non-zero predetermined bleeding flow rate to eject the at least some of the first fluid from the first chamber into the third chamber.

5. The pressure-driven metered mixing dispensing pump as defined in claim 1, wherein the spraying of the at least some of the first fluid from the first chamber into the third chamber causes all of the second fluid in the third chamber to be removed from the third chamber.

6. The pressure-driven metered mixing dispensing pump as defined in claim 1, further comprising a cap friction welded to the housing, the cap having a fluid inlet defined therein between a first fluid source and the first chamber, or between a second fluid source and the second chamber.

7. The pressure-driven metered dispensing pump as defined in claim 1, wherein the first fluid is supplied by a domestic water source, and the second fluid comprises a laundry treating chemistry.

8. The pressure-driven metered mixing dispensing pump as defined in claim 1, further comprising a fluid inlet is disposed between a first fluid source and the first chamber.

9. The pressure-driven metered mixing dispensing pump as defined in claim 1, further comprising a position sensor to sense a position of the piston.

10. The pressure-driven metered mixing dispensing pump as defined in claim 9, wherein an amount of the second fluid ejected into the third chamber is controlled based on the sensed position of the piston.

11. The pressure-driven metered mixing dispensing pump as defined in claim 1, further comprising a first one-way valve positioned between the second chamber and the third chamber.

12. The pressure-driven metered mixing dispensing pump as defined in claim 11, further comprising a spring configured to move the piston from the second position to the first position.

13. The pressure-driven metered mixing dispensing pump as defined in claim 11, wherein the first one-way valve is disposed at least partially within the piston.

14. The pressure-driven metered mixing dispensing pump as defined in claim 11, wherein the first fluid entering the first chamber causes the piston to move from the first position to the second position.

15. The pressure-driven metered mixing dispensing pump as defined in claim further comprising a second one-way valve positioned between a treating chemistry inlet and the second chamber.

16. The pressure-driven metered mixing dispensing pump as defined in claim 15, wherein an additional second fluid is drawn into the second chamber via the second one-way valve when a spring moves the piston from the second position to the first position.

17. The pressure-driven metered mixing dispensing pump as defined in claim 15, further comprising a third one-way valve positioned in a fluid inlet disposed between a first fluid source and the first chamber.

18. A pressure-driven metered mixing dispensing pump, comprising:

a housing;

a piston disposed in the housing at least partially defining first, second and third chambers within the housing;

the first and second chambers in fluid communication with the third chamber; and a first one-way valve positioned between the second chamber and the third chamber;

wherein the piston is selectively controllable to move between a first position and a second position:

wherein in the first position, substantially none of a first fluid in the first chamber is directed into the third chamber;

wherein in the second position, a volume of the first chamber is expanded and substantially all of the first fluid in the first chamber is directed into the third chamber and a volume of the second chamber is contracted causing a second fluid from the second chamber to enter the third chamber and be mixed in the third chamber with the first fluid from the first chamber; and wherein the first fluid entering the first chamber causes the piston to move from the first position to the second position.

19. A pressure-driven metered mixing dispensing pump, comprising:

a housing;

a piston disposed in the housing at least partially defining first, second and third chambers within the housing;

the first and second chambers in fluid communication with the third chamber and a first one-way valve positioned between the second chamber and the third chamber and a second one-way valve positioned between a treating chemistry inlet and the second chamber;

wherein the piston is selectively controllable to move between a first position and a second position:

wherein in the first position, substantially none of a first fluid in the first chamber is directed into the third chamber;

wherein in the second position, a volume of the first chamber is expanded and substantially all of the first fluid in the first chamber is directed into the third chamber and a volume of the second chamber is contracted causing a second fluid from the second chamber to enter the third chamber and be mixed in the third chamber with the first fluid from the first chamber; and wherein an additional second fluid is drawn into the second chamber via the second one-way valve when a spring moves the piston from the second position to the first position.

* * * * *